US009932699B2

(12) United States Patent
Kim

(10) Patent No.: US 9,932,699 B2
(45) Date of Patent: Apr. 3, 2018

(54) WASHING METHOD AND WASHING MACHINE

(75) Inventor: Pyoung Hwan Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 937 days.

(21) Appl. No.: 13/145,203

(22) PCT Filed: Feb. 11, 2010

(86) PCT No.: PCT/KR2010/000884

§ 371 (c)(1),
(2), (4) Date: Jul. 19, 2011

(87) PCT Pub. No.: WO2010/093185

PCT Pub. Date: Aug. 19, 2010

(65) Prior Publication Data

US 2012/0017380 A1 Jan. 26, 2012

(30) Foreign Application Priority Data

Feb. 11, 2009 (KR) ..... 10-2009-0011050
Feb. 11, 2009 (KR) ..... 10-2009-0011051
Feb. 11, 2009 (KR) ..... 10-2009-0011052

(51) Int. Cl.
*D06F 35/00* (2006.01)
*D06F 39/00* (2006.01)

(52) U.S. Cl.
CPC ..... *D06F 35/006* (2013.01); *D06F 39/003* (2013.01)

(58) Field of Classification Search
CPC ..... D06F 39/003
See application file for complete search history.

(56) References Cited

U.S. PATENT DOCUMENTS

| | | | | |
|---|---|---|---|---|
| 2,432,766 | A | 12/1947 | Kirby | 68/19 |
| 2,540,717 | A | 2/1951 | Diether | 68/12 |
| 2,556,490 | A | 6/1951 | Chamberlin | 8/159 |
| 2,942,447 | A | 6/1960 | Rickel et al. | 68/24 |
| 3,387,310 | A | 6/1968 | Marshall | 8/158 |
| 3,388,410 | A | 6/1968 | Marshall | 8/158 |
| 3,811,300 | A | 5/1974 | Barton et al. | 68/12 |

(Continued)

FOREIGN PATENT DOCUMENTS

| | | | |
|---|---|---|---|
| CN | 1300892 | A | 6/2001 |
| CN | 1070953 | C | 9/2001 |

(Continued)

OTHER PUBLICATIONS

United States Office Action dated Oct. 6, 2014 issued in U.S. Appl. No. 12/854,330.

(Continued)

*Primary Examiner* — Jason Ko
(74) *Attorney, Agent, or Firm* — KED & Associates, LLP

(57) ABSTRACT

A washing method and a washing machine, more specifically, to a washing method which improves a washing ability and a washing machine are disclosed. The washing method includes a laundry amount detecting step of detecting the amount of laundry loaded in a drum; and a high head motion step of dropping the laundry by braking the drum after the laundry is lifted over a half of the drum height by rotation of the drum, when the detected amount of the laundry is in a preset range.

12 Claims, 8 Drawing Sheets

(56) References Cited

U.S. PATENT DOCUMENTS

| | | | | |
|---|---|---|---|---|
| 4,489,574 | A | 12/1984 | Spendel | 68/16 |
| 4,916,768 | A | 4/1990 | Broadbent | 8/159 |
| 5,012,658 | A * | 5/1991 | Shikamori | D06F 13/02 68/12.01 |
| 5,191,668 | A | 3/1993 | Euler et al. | 8/158 |
| 5,219,370 | A | 6/1993 | Farrington et al. | |
| 5,335,524 | A | 8/1994 | Sakane | 68/12.04 |
| 5,560,061 | A | 10/1996 | Wentzlaff et al. | 8/159 |
| 5,758,377 | A | 6/1998 | Cimetta et al. | 8/158 |
| 5,768,730 | A | 6/1998 | Matsumoto et al. | 8/159 |
| 5,813,069 | A | 9/1998 | Kim | 8/159 |
| 5,870,905 | A | 2/1999 | Imamura et al. | 68/12.04 |
| 6,023,854 | A | 2/2000 | Tsunomoto et al. | 34/531 |
| 6,029,299 | A | 2/2000 | Baek et al. | 8/159 |
| 6,158,072 | A | 12/2000 | Baek et al. | 8/159 |
| 6,401,284 | B1 | 6/2002 | Jeon et al. | 8/158 |
| 6,460,382 | B1 | 10/2002 | Kim et al. | 68/140 |
| 7,127,767 | B2 | 10/2006 | McAllister et al. | 8/159 |
| 7,146,669 | B2 | 12/2006 | Orszulik | 8/158 |
| 7,331,075 | B2 | 2/2008 | Lee et al. | 8/159 |
| 7,478,547 | B2 | 1/2009 | Okazaki et al. | 68/12.04 |
| 7,490,490 | B2 | 2/2009 | Hirasawa et al. | 68/12.04 |
| 7,530,133 | B2 | 5/2009 | Mitts | 8/159 |
| RE40,732 | E | 6/2009 | Jeon et al. | 8/158 |
| 7,568,366 | B2 | 8/2009 | Chang et al. | |
| 7,739,765 | B2 | 6/2010 | Ashrafzadeh et al. | 8/159 |
| 2001/0054203 | A1 | 12/2001 | Bringewatt et al. | 8/159 |
| 2003/0020431 | A1 | 1/2003 | Kiuchi et al. | 318/779 |
| 2003/0089139 | A1 | 5/2003 | Orszulik | 65/58 |
| 2003/0208852 | A1 | 11/2003 | Hardaway et al. | 8/158 |
| 2003/0208855 | A1 | 11/2003 | McAllister et al. | 8/159 |
| 2004/0148710 | A1 | 8/2004 | Kim | 8/159 |
| 2004/0158933 | A1 | 8/2004 | Seo et al. | |
| 2004/0194226 | A1 | 10/2004 | Kim et al. | |
| 2005/0016227 | A1 | 1/2005 | Lee | |
| 2005/0044641 | A1 | 3/2005 | Hyeong | |
| 2005/0050646 | A1 | 3/2005 | Lee et al. | 8/158 |
| 2005/0066999 | A1 | 3/2005 | Dietz et al. | 134/18 |
| 2005/0120492 | A1 | 6/2005 | Koo et al. | 8/159 |
| 2005/0160536 | A1 | 7/2005 | McAllister et al. | 8/137 |
| 2005/0223504 | A1 | 10/2005 | Lee et al. | 8/158 |
| 2005/0268669 | A1 | 12/2005 | Ko et al. | 68/12.05 |
| 2005/0268670 | A1 | 12/2005 | Hirasawa et al. | 68/12.06 |
| 2005/0284192 | A1 | 12/2005 | Altinier et al. | |
| 2006/0021392 | A1 | 2/2006 | Hosoito et al. | 68/12.04 |
| 2006/0048548 | A1 | 3/2006 | Park et al. | 68/12.06 |
| 2006/0112496 | A1 | 6/2006 | Kim | 8/147 |
| 2006/0185095 | A1 | 8/2006 | Mitts | 8/158 |
| 2007/0006394 | A1 | 1/2007 | Chang et al. | 8/158 |
| 2007/0017262 | A1 | 1/2007 | McAllister et al. | 68/23.7 |
| 2007/0124871 | A1 | 6/2007 | Kwon et al. | 8/159 |
| 2007/0130700 | A1 | 6/2007 | Cho et al. | 8/158 |
| 2007/0283507 | A1 | 12/2007 | Wong et al. | |
| 2008/0083132 | A1 | 4/2008 | Schaub et al. | 34/318 |
| 2008/0172804 | A1 | 7/2008 | Vanhazebrouck et al. | 8/158 |
| 2008/0196172 | A1 | 8/2008 | Jeong | 8/159 |
| 2008/0201867 | A1 | 8/2008 | Bang et al. | 8/158 |
| 2008/0201868 | A1 | 8/2008 | Bang et al. | |
| 2008/0222818 | A1 | 9/2008 | Yun et al. | 8/159 |
| 2008/0250824 | A1 | 10/2008 | Oh et al. | 68/5 |
| 2008/0276382 | A1 | 11/2008 | Benne et al. | 8/158 |
| 2008/0289118 | A1 | 11/2008 | Park et al. | 8/159 |
| 2008/0297098 | A1 | 12/2008 | Hollenbeck et al. | 318/757 |
| 2009/0019896 | A1 * | 1/2009 | Kim et al. | 68/17 R |
| 2009/0100608 | A1 | 4/2009 | Lee et al. | |
| 2009/0126222 | A1 | 5/2009 | Bae et al. | 34/527 |
| 2009/0145172 | A1 | 6/2009 | Lubert et al. | |
| 2009/0183319 | A1 | 7/2009 | Chai et al. | |
| 2009/0199350 | A1 | 8/2009 | Fechler et al. | 8/158 |
| 2009/0249838 | A1 | 10/2009 | Kim et al. | 68/58 |
| 2009/0249840 | A1 | 10/2009 | Jo et al. | |
| 2010/0005680 | A1 | 1/2010 | Kim et al. | 34/130 |
| 2010/0162586 | A1 | 7/2010 | Lee | 34/130 |
| 2010/0205753 | A1 | 8/2010 | Kim et al. | 8/137 |

FOREIGN PATENT DOCUMENTS

| | | | |
|---|---|---|---|
| CN | 1521305 | A | 8/2004 |
| CN | 1521311 | A | 8/2004 |
| CN | 1534128 | A | 10/2004 |
| CN | 1580374 | A | 2/2005 |
| CN | 1609331 | A | 4/2005 |
| CN | 1637197 | A | 7/2005 |
| CN | 1680648 | A | 10/2005 |
| CN | 1782191 | A | 6/2006 |
| CN | 100344818 | | 10/2007 |
| CN | 101046046 | A | 10/2007 |
| CN | 101168894 | A | 4/2008 |
| CN | 101397745 | A | 4/2009 |
| CN | 101514521 | | 8/2009 |
| CN | 101517141 | A | 8/2009 |
| CN | 101332234 | A | 9/2009 |
| CN | 101812787 | A | 8/2010 |
| CN | 101812790 | A | 8/2010 |
| DE | 24 16 518 | A1 | 10/1975 |
| DE | 196 19 603 | A1 | 11/1997 |
| DE | 198 32 292 | A1 | 1/2000 |
| DE | 102 34 473 | A1 | 2/2004 |
| DE | 103 26 551 | A1 | 1/2005 |
| DE | 10 2005 003 695 | A1 | 7/2006 |
| EP | 0 247 421 | A2 | 12/1987 |
| EP | 0 399 406 | A2 | 11/1990 |
| EP | 0 465 885 | A1 | 1/1992 |
| EP | 0 542 137 | A1 | 5/1993 |
| EP | 0 618 323 | A1 | 10/1994 |
| EP | 0 629 733 | A1 | 12/1994 |
| EP | 0 704 567 | A1 | 4/1996 |
| EP | 0 742 307 | A1 | 11/1996 |
| EP | 0 781 881 | A1 | 7/1997 |
| EP | 0 796 942 | A2 | 9/1997 |
| EP | 1 111 117 | A1 | 6/2001 |
| EP | 1 116 812 | A1 | 7/2001 |
| EP | 1 164 217 | A1 | 12/2001 |
| EP | 1 380 682 | A2 | 1/2004 |
| EP | 1 428 925 | | 6/2004 |
| EP | 1 447 468 | A1 | 8/2004 |
| EP | 1 524 357 | A2 | 4/2005 |
| EP | 1 555 338 | A2 | 7/2005 |
| EP | 1 555 340 | A2 | 7/2005 |
| EP | 1 612 316 | A1 | 1/2006 |
| EP | 1 619 284 | A1 | 1/2006 |
| EP | 1 619 286 | A2 | 1/2006 |
| EP | 1 634 985 | A1 | 3/2006 |
| EP | 1 788 138 | A1 | 5/2007 |
| EP | 1 865 098 | A1 | 12/2007 |
| EP | 1 983 088 | A1 | 10/2008 |
| EP | 1 995 366 | A1 | 11/2008 |
| EP | 2 042 638 | A1 | 4/2009 |
| EP | 2 080 832 | A1 | 7/2009 |
| EP | 2 090 686 | A1 | 8/2009 |
| EP | 2 103 726 | A | 9/2009 |
| FR | 2 103 369 | | 4/1972 |
| FR | 2 921 079 | A1 | 3/2009 |
| GB | 1 329 544 | A | 9/1973 |
| GB | 2 253 215 | A | 9/1992 |
| GB | 2 269 395 | A | 2/1994 |
| GB | 2 325 245 | | 11/1998 |
| JP | S58-130089 | A | 8/1983 |
| JP | S59-36240 | Y2 | 10/1984 |
| JP | 64-020897 | A | 1/1989 |
| JP | 01-288596 | A | 11/1989 |
| JP | 05-184769 | A | 7/1993 |
| JP | 05-212189 | A | 8/1993 |
| JP | 08-266776 | A | 10/1996 |
| JP | 09-239189 | A | 9/1997 |
| JP | 09-276582 | A | 10/1997 |
| JP | 10-216390 | A | 8/1998 |
| JP | H10-201991 | A | 8/1998 |
| JP | H10328468 | A | 12/1998 |
| JP | 2000-254385 | A | 9/2000 |
| JP | 2001-009188 | A | 1/2001 |
| JP | 2001-046779 | A | 2/2001 |
| JP | 2001-095935 | A | 4/2001 |
| JP | 2001-224886 | A | 8/2001 |

(56) References Cited

FOREIGN PATENT DOCUMENTS

| | | | |
|---|---|---|---|
| JP | 2001-232091 | A | 8/2001 |
| JP | 2002-119796 | A | 4/2002 |
| JP | 2002-153696 | A | 5/2002 |
| JP | 3296712 | B2 | 7/2002 |
| JP | 2002-282587 | A | 10/2002 |
| JP | 2003-284898 | | 10/2003 |
| JP | 2004-057821 | A | 2/2004 |
| JP | 2004-081652 | A | 3/2004 |
| JP | 2005-006843 | | 1/2005 |
| JP | 2005-131117 | A | 5/2005 |
| JP | 2005424764 | A | 5/2005 |
| JP | 2005-152309 | A | 6/2005 |
| JP | 2005-296631 | A | 10/2005 |
| JP | 2006-068193 | A | 3/2006 |
| JP | 2006-239142 | A | 9/2006 |
| JP | 2006-247367 | A | 9/2006 |
| JP | 2007-054416 | A | 3/2007 |
| JP | 2007-068804 | A | 3/2007 |
| JP | 2007-117140 | A | 5/2007 |
| JP | 2007-117377 | A | 5/2007 |
| JP | 2007-175528 | A | 7/2007 |
| JP | 2008-049270 | A | 3/2008 |
| JP | 2008-054826 | A | 3/2008 |
| JP | 2008-073128 | A | 4/2008 |
| JP | 4100576 | B1 | 6/2008 |
| JP | 2008-194255 | A | 8/2008 |
| JP | 2008-194256 | A | 8/2008 |
| JP | 2008-194257 | A | 8/2008 |
| JP | 2008-194258 | A | 8/2008 |
| JP | 2008-220620 | A | 9/2008 |
| JP | 2009-077747 | A | 4/2009 |
| JP | 2009-082258 | | 4/2009 |
| JP | 2009-160327 | A | 7/2009 |
| JP | 2009-165682 | | 7/2009 |
| JP | 2009-213800 | A | 9/2009 |
| JP | 4325736 | | 9/2009 |
| KR | 20-0136636 | | 9/1994 |
| KR | 10-1996-0034548 | A | 10/1996 |
| KR | 10-1998-0060338 | | 10/1998 |
| KR | 10-1998-0077930 | | 11/1998 |
| KR | 10-1999-0015909 | A | 3/1999 |
| KR | 10-0205411 | B1 | 4/1999 |
| KR | 10-0219267 | B1 | 6/1999 |
| KR | 20-0154059 | Y1 | 8/1999 |
| KR | 10-0220275 | B1 | 9/1999 |
| KR | 10-0245429 | B1 | 11/1999 |
| KR | 10-2001-0004704 | A | 1/2001 |
| KR | 10-2001-00112681 | A | 12/2001 |
| KR | 10-0315812 | B1 | 12/2001 |
| KR | 10-2002-0010339 | A | 2/2002 |
| KR | 10-2003-0004700 | A | 1/2003 |
| KR | 10-2003-0049822 | A | 6/2003 |
| KR | 10-2004-0046081 | A | 6/2004 |
| KR | 10-2004-0058999 | A | 7/2004 |
| KR | 10-2004-0073782 | A | 8/2004 |
| KR | 10-2004-0110973 | A | 12/2004 |
| KR | 10-0653767 | B1 | 12/2004 |
| KR | 10-2005-0000593 | A | 1/2005 |
| KR | 10-2005-0015687 | A | 2/2005 |
| KR | 10-2005-0017490 | A | 2/2005 |
| KR | 10-2005-0022209 | A | 3/2005 |
| KR | 10-2005-0039624 | A | 4/2005 |
| KR | 10-2005-0061701 | A | 6/2005 |
| KR | 10-0511290 | B1 | 6/2005 |
| KR | 10-0504501 | B1 | 7/2005 |
| KR | 10-2005-0093260 | A | 9/2005 |
| KR | 10-2005-0097755 | A | 10/2005 |
| KR | 10-2005-0098522 | A | 10/2005 |
| KR | 10-0531333 | B1 | 11/2005 |
| KR | 10-2005-0115764 | A | 12/2005 |
| KR | 10-2005-0121052 | A | 12/2005 |
| KR | 10-2006-0001154 | A | 1/2006 |
| KR | 10-2006-0008111 | A | 1/2006 |
| KR | 10-2006-0019982 | | 3/2006 |
| KR | 10-2006-0023067 | A | 3/2006 |
| KR | 10-2006-0040814 | | 5/2006 |
| KR | 10-2006-0042636 | A | 5/2006 |
| KR | 10-2006-0064119 | A | 6/2006 |
| KR | 10-2006-0089069 | | 8/2006 |
| KR | 10-2006-0107037 | | 10/2006 |
| KR | 10-0630225 | B1 | 10/2006 |
| KR | 10-2006-0117528 | A | 11/2006 |
| KR | 10-2006-0120934 | A | 11/2006 |
| KR | 10-0651977 | B1 | 11/2006 |
| KR | 10-2006-0124219 | A | 12/2006 |
| KR | 10-2006-0124224 | A | 12/2006 |
| KR | 10-2007-0001607 | A | 1/2007 |
| KR | 10-2007-0001611 | A | 1/2007 |
| KR | 10-2007-0018613 | A | 2/2007 |
| KR | 10-2007-0034901 | A | 3/2007 |
| KR | 10-2007-0038729 | A | 4/2007 |
| KR | 10-2007-0040617 | A | 4/2007 |
| KR | 10-0719845 | B1 | 5/2007 |
| KR | 10-2007-0063658 | A | 6/2007 |
| KR | 10-2007-0067389 | | 6/2007 |
| KR | 10-2007-0073136 | A | 7/2007 |
| KR | 10-0737452 | B1 | 7/2007 |
| KR | 10-0739612 | B1 | 7/2007 |
| KR | 10-0740065 | B1 | 7/2007 |
| KR | 10-0740841 | B1 | 7/2007 |
| KR | 10-2007-0089536 | A | 8/2007 |
| KR | 10-0751780 | B1 | 8/2007 |
| KR | 10-2007-0101732 | A | 10/2007 |
| KR | 10-2007-0120326 | A | 12/2007 |
| KR | 10-2008-0010589 | A | 1/2008 |
| KR | 10-2008-0010593 | | 1/2008 |
| KR | 10-2008-0015300 | A | 2/2008 |
| KR | 10-2008-0018450 | A | 2/2008 |
| KR | 10-2008-0041143 | A | 5/2008 |
| KR | 10-2008-0045996 | A | 5/2008 |
| KR | 10-2008-0057711 | A | 6/2008 |
| KR | 10-2008-0057723 | A | 6/2008 |
| KR | 10-2008-0069857 | A | 7/2008 |
| KR | 10-2008-0070275 | A | 7/2008 |
| KR | 10-2008-0073451 | A | 8/2008 |
| KR | 10-2008-0079458 | A | 9/2008 |
| KR | 10-2008-0084363 | A | 9/2008 |
| KR | 10-0857797 | B1 | 9/2008 |
| KR | 10-2008-0087597 | A | 10/2008 |
| KR | 10-2008-0094290 | A | 10/2008 |
| KR | 10-2008-0107097 | A | 12/2008 |
| KR | 10-2009-0013354 | A | 2/2009 |
| KR | 10-2009-0037860 | A | 4/2009 |
| KR | 10-2009-0080608 | A | 7/2009 |
| KR | 10-2009-0080821 | A | 7/2009 |
| KR | 10-2009-0085749 | A | 8/2009 |
| KR | 10-2009-0107223 | A | 10/2009 |
| KR | 10-2010-0014052 | A | 2/2010 |
| KR | 10-2010-0028920 | A | 3/2010 |
| KR | 10-2010-0091721 | A | 8/2010 |
| KR | 10-0984583 | B1 | 9/2010 |
| KR | 10-2011-0016314 | A | 2/2011 |
| KR | 10-2011-0016330 | A | 2/2011 |
| KR | 10-1012594 | B1 | 2/2011 |
| MT | 10-0576282 | B1 | 5/2006 |
| RU | 1994038773 | | 7/1996 |
| RU | 2 089 691 | C1 | 9/1997 |
| RU | 2 096 546 | C1 | 11/1997 |
| RU | 2006145871 | A | 2/2006 |
| RU | 2005122725 | A | 1/2007 |
| RU | 2 293 806 | C2 | 2/2007 |
| RU | 2 339 751 | C2 | 6/2008 |
| RU | 2 398 059 | C1 | 8/2010 |
| SU | 242774 | | 4/1969 |
| SU | 1043207 | A | 9/1983 |
| SU | 1694744 | A1 | 11/1991 |
| TW | 200840905 | A | 10/2008 |
| TW | 200840906 | A | 10/2008 |
| WO | WO 98/29594 | A2 | 7/1998 |
| WO | WO 01/59196 | A1 | 8/2001 |
| WO | WO 2006/009380 | | 1/2006 |
| WO | WO 2006/090973 | A1 | 8/2006 |
| WO | WO 2007/024050 | A1 | 3/2007 |
| WO | WO 2008/030066 | A2 | 3/2008 |

(56) References Cited

FOREIGN PATENT DOCUMENTS

| | | | |
|---|---|---|---|
| WO | WO 2008/069607 | A1 | 6/2008 |
| WO | WO 2008/075987 | A2 | 6/2008 |
| WO | WO 2008/099547 | A1 | 8/2008 |
| WO | WO 2008/099548 | A1 | 8/2008 |
| WO | WO 2008/099549 | A1 | 8/2008 |
| WO | WO 2008/123695 | A2 | 10/2008 |
| WO | WO 2009/017361 | A2 | 2/2009 |
| WO | WO 2009/112222 | A1 | 9/2009 |
| WO | WO 2011/053097 | A2 | 5/2011 |

OTHER PUBLICATIONS

United States Office Action dated Oct. 10, 2014 issued in U.S. Appl. No. 12/854,263.
European Search Report dated Oct. 16, 2014 issued in Application No. 10823602.7 (Full English Text).
United States Notice of Allowance dated Oct. 20, 2014 issued in U.S. Appl. No. 13/420,819.
United States Final Office Action dated Dec. 11, 2014 issued in U.S. Appl. No. 12/509,682.
United States Final Office Action dated Dec. 29, 2014 issued in U.S. Appl. No. 12/749,760.
United States Office Action dated Jan. 5, 2015 issued in U.S. Appl. No. 13/392,597.
Front Loading Automatic Washer, Use and Care Guide [online] Maytag; Aug. 18, 2006; [retrieved on Feb. 9, 2011]; Retrieved from the Internet: <URL: http://dl.owneriq.net/ 1/11ea371b-d431-44f5-8002-03a5d6ab459.pdf>; pp. 1-72.
European Search Report dated Dec. 4, 2009 issued in Application No. 09 01 0403.5.
PCT International Search Report dated May 7, 2010 issued in Application No. PCT/KR2009/005094.
PCT International Search Report and Written Opinion dated Nov. 30, 2010 issued in Application No. PCT/KR2010/001992.
PCT International Search Report and Written Opinion dated Jan. 24, 2011 issued in Application No. PCT/KR2010/05266.
PCT International Search Report and Written Opinion dated Jan. 24, 2011 issued in Application No. PCT/KR2010/05258.
PCT International Search Report and Written Opinion dated Jan. 31, 2011 issued in Application No. PCT/KR2010/05257.
PCT International Search Report and Written Opinion dated Jan. 31, 2011 issued in Application No. PCT/KR2010/05260.
PCT International Search Report and Written Opinion dated Feb. 25, 2011 issued in Application No. PCT/KR2010/005255.
PCT International Search Report and Written Opinion dated Feb. 25, 2011 issued in Application No. PCT/KR2010/005807.
Chinese Office Action dated Mar. 2, 2011 issued in Application No. 200910171046.9 (with translation).
PCT International Search Report and Written Opinion dated Apr. 8, 2011 issued in Application No. PCT/KR2010/006999.
PCT International Search Report and Written Opinion dated Apr. 26, 2011 issued in Application No. PCT/KR2010/007664.
Korean Office Action issued in Application No. 10-2009-0087141 dated May 13, 2011 (full Korean text and full English translation).
Korean Office Action dated May 31, 2011 issued in Application No. 10-2008-0087871.
Korean Office Action dated May 31, 2011 issued in Application No. 10-2009-0073976.
Korean Office Action issued in Application No. 10-2009-0073978 dated Jun. 24, 2011 (full Korean text and English translation).
International Search Report dated Jul. 4, 2011 issued in Application No. PCT/KR2010/006991.
International Search Report and Written Opinion issued PCT Application No. PCT/KR2010/007670 dated Aug. 16, 2011.
International Search Report and Written Opinion issued in PCT Application No. PCT/KR2011/000904 dated Sep. 21, 2011.
Korean Notice of Allowance issued in Application No. 10-2009-0087141 dated Sep. 21, 2011 (full Korean text and full English translation).
Korean Notice of Allowance issued in Application No. 10-2009-0073978 dated Sep. 27, 2011 (full Korean text and English translation).
International Search Report dated Dec. 7, 2011 issued in Application No. PCT/KR2010/007672.
International Search Report dated Dec. 22, 2011 issued in Application No. PCT/KR2010/007673.
United States Office Action dated Jul. 25, 2012 issued in U.S. Appl. No. 13/420,839.
Mexican Office Action dated Aug. 21, 2012 issued in Application No. MX/a/2011/010211 (with English Translation).
Chinese Office Action dated Sep. 5, 2012 issued in Application No. 201080005759.9 (with English Translation).
United States Office Action dated Sep. 7, 2012 issued in U.S. Appl. No. 12/509,682.
United States Office Action dated Sep. 7, 2012 issued in U.S. Appl. No. 13/420,819.
United States Office Action dated Sep. 25, 2012 issued in U.S. Appl. No. 12/749,760.
European Search Report dated Sep. 21, 2012 issued in Application No. 09 009 792.4.
United States Office Action dated Oct. 24, 2012 issued in U.S. Appl. No. 12/509,693.
Chinese Office Action dated Dec. 5, 2012 issued in Application No. 201080019657.2 (with English translation).
U.S. Final Office Action dated Dec. 13, 2012 issued in U.S. Appl. No. 12/509,682.
U.S. Final Office Action dated Nov. 14, 2012 issued in U.S. Appl. No. 13/420,839.
United States Office Action dated Feb. 1, 2013 issued in U.S. Appl. No. 13/420,819.
United States Office Action dated Feb. 4, 2013 issued in U.S. Appl. No. 12/749,760.
Chinese Office Action dated Jan. 6, 2013 issued in Application No. 201080019656.8 (with English translation).
European Search Report dated Nov. 13, 2014 issued in Application No. 10823597.9.
United States Office Action dated Feb. 9, 2015 issued in U.S. Appl. No. 12/938,078.
United States Final Office Action dated Feb. 10, 2015 issued in U.S. Appl. No. 12/938,034.
United States Final Office Action dated Feb. 12, 2015 issued in U.S. Appl. No. 12/509,693.
U.S. Notice of Allowance issued in U.S. Appl. No. 13/420,839 dated Dec. 23, 2013.
U.S. Office Action issued in U.S. Appl. No. 12/938,110 dated Dec. 30, 2013.
U.S. Final Office Action issued in U.S. Appl. No. 12/509,682 dated Jan. 13, 2014.
U.S. Notice of Allowance issued in U.S. Appl. No. 12/854,372 dated Jan. 27, 2014.
U.S. Final Office Action issued in U.S. Appl. No. 12/854,263 dated Feb. 20, 2014.
U.S. Notice of Allowance issued in U.S. Appl. No. 12/853,346 dated Feb. 20, 2014.
U.S. Office Action issued in U.S. Appl. No. 12/509,693 dated Feb. 21, 2014.
U.S. Final Office Action issued in U.S. Appl. No. 12/854,330 dated Feb. 21, 2014.
U.S. Office Action issued in U.S. Appl. No. 12/938,078 dated Feb. 28, 2014.
U.S. Notice of Allowance issued in U.S. Appl. No. 12/902,396 dated Mar. 7, 2014.
Chinese Office Action dated Feb. 20, 2014 issued in Application No. 201080042220.0 (with English translation).
Chinese Office Action dated Mar. 19, 2014 issued in Application No. 201080046534.8 (with English translation).
U.S. Office Action dated Mar. 31, 2014 issued in U.S. Appl. No. 12/938,135.
U.S. Office Action dated Apr. 11, 2014 issued in U.S. Appl. No. 12/902,300.
U.S. Final Office Action dated Apr. 21, 2014 issued in U.S. Appl. No. 12/938,110.

(56) References Cited

OTHER PUBLICATIONS

Chinese Office Action dated Apr. 2, 2014 issued in Application No. 201080048027.8.
United States Office Action dated May 28, 2014 issued in U.S. Appl. No. 12/749,760.
United States Final Office Action dated Jun. 5, 2014 issued in U.S. Appl. No. 12/509,693.
International Search Report issued in PCT Application No. PCT/KR2010/000884 dated Sep. 28, 2010.
Russian Office Action dated May 22, 2013 issued in Application No. 2012111656 (with English translation).
Russian Notice of Allowance dated Jun. 3, 2013 issued in Application No. 2011147906 (with English translation).
United States Final Office Action dated Jun. 14, 2013 issued in U.S. Appl. No. 12/902,396.
Russian Notice of Allowance dated Jul. 1, 2013 issued in Application No. 2011146523 (with English translation).
Russian Office Action dated Jul. 9, 2013 issued in Application No. 2011147901 (with English translation).
United States Office Action dated Jul. 17, 2013 issued in U.S. Appl. No. 12/509,693.
United States Final Office Action dated Jul. 29, 2013 issued in U.S. Appl. No. 12/749,760.
Russian Decision to Grant a Patent dated Jul. 19, 2013 issued in Application No. 2012111656 (with English translation).
Taiwanese Office Action dated Sep. 11, 2013 issued in Application No. 099126791 (with English translation).
United States Office Action dated Sep. 24, 2013 issued in U.S. Appl. No. 12/902,396.
United States Office Action dated Sep. 27, 2013 issued in U.S. Appl. No. 12/509,682.
United States Office Action dated Oct. 2, 2013 issued in U.S. Appl. No. 12/854,372.
Russian Decision to Grant a Patent dated Oct. 9, 2013 issued in Application No. 2011146527 (with English translation).
United States Office Action dated Oct. 22, 2013 issued in U.S. Appl. No. 12/854,346.
United States Office Action dated Oct. 23, 2013 issued in U.S. Appl. No. 12/854,263.
United States Office Action dated Oct. 23, 2013 issued in U.S. Appl. No. 12/854,330.
United States Final Office Action dated Oct. 28, 2013 issued in U.S. Appl. No. 12/509,693.
United States Office Action dated Aug. 22, 2014 issued in U.S. Appl. No. 12/938,110.
United States Final Office Action dated Sep. 2, 2014 issued in U.S. Appl. No. 12/938,078.
United States Final Office Action dated Sep. 9, 2014 issued in U.S. Appl. No. 12/938,135.
United States Office Action dated Sep. 19, 2014 issued in U.S. Appl. No. 12/938,034.
United States Office Action dated Sep. 24, 2014 issued in U.S. Appl. No. 12/509,693.
Russian Office Action dated Jun. 27, 2012 issued in Application No. 2011132395/12.
Chinese Office Action translation). dated Jul. 19, 2013 issued in Application No. 201080019658.7 (with English translation).
Japanese Office Action dated Jul. 26, 2013 issued in Application No. 2012-534107.
Taiwanese Office Action dated Aug. 8, 2013 issued in Application No. 099126789 (with English translation).
Taiwan Office Action dated Jan. 23, 2013 issued in Application No. 099126789 (with English translation).
Australian Office Action dated Jan. 29, 2013 issued in Application No. 2010287154.
U.S. Office Action dated Mar. 7, 2013 issued in U.S. Appl. No. 12/902,396.
U.S. Office Action dated Apr. 2, 2013 issued in U.S. Appl. No. 12/509,693.
U.S. Final Office Action dated Jul. 21, 2014 issued in U.S. Appl. No. 12/902,300.
U.S. Office Action dated Jul. 31, 2014 issued in U.S. Appl. No. 12/509,682.
European Search Report dated Jan. 21, 2015 issued in Application No. 10812324.1.
United States Final Office Action dated Feb. 26, 2015 issued in U.S. Appl. No. 12/854,330.
United States Final Office Action dated Feb. 26, 2015 issued in U.S. Appl. No. 12/938,135.
United States Final Office Action dated Mar. 16, 2015 issued in U.S. Appl. No. 12/938,110.
United States Office Action dated May 6, 2015 issued in U.S. Appl. No. 14/304,541.
U.S. Final Office Action issued in co-pending U.S. Appl. No. 12/938,110 dated Feb. 17, 2016.
U.S. Office Action issued in co-pending U.S. Appl. No. 13/392,597 dated Dec. 21, 2015.
U.S. Final Office Action issued in a co-pending U.S. Appl. No. 12/938,034 dated Dec. 16, 2015.
Final U.S. Office Action issued in a co-pending U.S. Appl. No. 12/938,078 dated Jun. 10, 2015.
European Search Report issued in Application No. 10808344.5 dated May 21, 2015.
European Search Report issued in Application No. 10808345.2 dated May 22, 2015.
European Search Report issued in Application No. 10808346.0 dated Jun. 1, 2015.
European Search Report issued in Application No. 10808348.6 dated Jun. 1, 2015.
U.S. Final Office Action issued in U.S. Appl. No. 12/854,263 dated Jun. 29, 2015.
U.S. Office Action issued in U.S. Appl. No. 12/938,034 dated Jul. 27, 2015.
U.S. Office Action issued in U.S. Appl. No. 12/938,110 dated Aug. 11, 2015.
U.S. Final Office Action issued in co-pending U.S. Appl. No. 13/392,597 dated Sep. 8, 2015.
U.S. Final Office Action issued in co-pending U.S. Appl. No. 12/938,135 dated Sep. 21, 2015.
Thomson; WPI Database; Thomson Scientific London, Great Britain; Week 200645; Abstract of KR 10-2005-0061701 dated Jun. 23, 2005 (previously submitted) (XP-002745090).
European Search Report issued in Application No. 10827181.8 dated Oct. 7, 2015.
European Search Report dated Oct. 8, 2015.
U.S. Office Action issued in co-pending U.S. Appl. No. 12/749,760 dated Nov. 30, 2015.
U.S. Office Action issued in co-pending U.S. Appl. No. 12/938,135 dated Jan. 4, 2016.
Chinese Office Action issued in Application No. 201410455750.8 dated Dec. 4, 2015.
European Search Report issued in Application No. 10759041.6 dated Dec. 21, 2015.
European Search Report issued in Application No. 10827178.4 dated May 3, 2016.
U.S. Final Office Action dated Aug. 9, 2016 issued in co-pending U.S. Appl. No. 12/854,263.
U.S. Final Office Action dated Sep. 8, 2016 issued in co-pending U.S. Appl. No. 12/938,034.
U.S. Office Action issued in co-pending U.S. Appl. No. 12/938,034 dated May 5, 2016.
U.S. Office Action issued in co-pending U.S. Appl. No. 12/938,110 dated May 27, 2016.
U.S. Office Action issued in co-pending U.S. Appl. No. 12/854,263 dated Apr. 26, 2016.
U.S. Final Office Action issued in U.S. Appl. No. 12/938,135 dated Aug. 3, 2016.
Chinese Office Action dated Sep. 28, 2016 issued in Application No. 201410483861.X (with English translation).
U.S. Office Action dated Dec. 9, 2016 issued in U.S. Appl. No. 12/938,135.

(56) References Cited

OTHER PUBLICATIONS

Korean Office Action dated Aug. 5, 2016 issued in Application No. 10-2010-0044794.
Korean Office Action dated Jul. 30, 2016 issued in Application No. 10-2009-0080128.
Korean Notice of Allowance dated Oct. 20, 2016 issued in Application No. 10-2011-0111434 (with English translation).
U.S. Final Office Action dated Jul. 14, 2016 issued in co-pending U.S. Appl. No. 13/392,597.
European Search Report dated Nov. 22, 2016 issued in Application No. 16184841.1.

* cited by examiner

WASHING METHOD AND WASHING MACHINE

CROSS-REFERENCE TO RELATED PATENT APPLICATIONS

This application is a U.S. National Stage Application under 35 U.S.C. § 371 of PCT Application No. PCT/KR2010/000884, filed Feb. 11, 2010, which claims priority to Korean Patent Application Nos. 10-2009-0011050, 10-2009-0011051, and 10-2009- 0011052, all filed Feb. 11, 2009.

TECHNICAL FIELD

The present invention relates to a washing method and a washing machine, more specifically, to a washing method which improves a washing ability and a washing machine.

BACKGROUND ART

Generally, a washing machine is an electric appliance which washes clothes, beddings and cloth items (hereinafter, referenced to as 'laundry) by using water, detergent and a mechanical action via washing, rinsing and spinning cycles, to remove contaminants.

The washing machine is categorized into an agitator type washing machine, a pulsator type washing machine and a drum type washing machine.

In the agitator type washing machine, an agitator vertically mounted in a center of a tub is rotated in a right and left direction to perform washing. In the pulsator type washing machine, a disc-shaped pulsator mounted below a tub is rotated in a right and left direction and washing is performed by a frictional force generated between water currents and laundry loaded therein. In the drum type washing machine, water, detergent and laundry are loaded into a drum and the drum is rotated to wash the laundry.

The drum type washing machine includes a cabinet configured to define a profile of the washing machine, a tub mounted in the cabinet to hold wash water, a drum mounted in the tub to receive laundry therein, a motor mounted to a rear surface of the tub to rotate the drum and a driving shaft connected to the motor and a rear surface of the drum, passing through the tub. A lifter is installed in the drum to lift the laundry when the drum is rotating.

While the drum is rotated, laundry is lifted by the lifter installed in such the drum type washing machine and the laundry is rotated in close contact with an inner circumferential surface of the drum to be lifted and dropped (hereinafter, 'tumbled'), to perform washing. Demands for various washing methods to improve a washing ability have been increasing, rather than such a tumbling motion.

DISCLOSURE OF INVENTION

Technical Problem

To solve the problems, an object of the present invention is to provide a method of washing laundry which can reduce damage to the laundry and which can improve a washing ability, and a washing machine.

Technical Solution

To achieve these objects and other advantages and in accordance with the purpose of the invention, as embodied and broadly described herein, a washing method includes a laundry amount detecting step of detecting the amount of laundry loaded in a drum; and a high head motion step of dropping the laundry by braking the drum after the laundry is lifted over a half of the drum height by rotation of the drum, when the detected amount of the laundry is in a preset range.

In another aspect of the present invention, a washing machine includes a tub for receiving wash water therein; a drum rotatably provided in the tub, the drum receiving laundry therein; and a driving part for performing a high head motion which drops the laundry by braking the drum after the laundry is lifted over a half of the drum height by rotating the drum, when the amount of the laundry is in a preset range.

In a further aspect of the present invention, a washing method includes a course inputting step of inputting a course for washing laundry loaded in a drum by using cold water; a water supplying step of supplying cold water to a tub surrounding the drum; and a high head motion step of dropping the laundry by braking the drum after the laundry is lifted over a half of the drum height by rotating the drum.

In a still further aspect of the present invention, a washing machine includes a drum rotatable, with receiving laundry therein; a control panel for receiving an input course for washing the laundry received in the drum by using cold water; a tub for surrounding the drum, with receiving cold water therein, when the course for washing the laundry by using the cold water is inputted to the control panel; and a driving part for performing a high head motion which drops the laundry by braking the drum, after the laundry passes the half of the drum height.

Advantageous Effects

The present invention has following one or more advantageous effects.

First, damage to laundry may be reduced and a washing ability may be improved advantageously.

Second, different drum motions are performed according to the amount of laundry and overload may be prevented advantageously.

Third, a new drum motion may be performed according to a mode selected by a user.

Fourth, combination of various drum motions may reduce the washing time advantageously.

Fifth, cold water is used to perform washing and energy may be saved advantageously.

Sixth, a new drum motion is performed when a cold water washing is performed and the washing ability may be improved advantageously.

Seventh, new drum motions may be performed according to the amount of laundry in the cold water washing advantageously.

Eighth, various drum motions are combined in the cold water washing and the washing ability may be improved advantageously.

Ninth, generation of overheat may be suppressed advantageously when a drum motion having much load is performed.

Tenth, a net acting ratio of a drum motion having much load is controlled and overheat generation may be suppressed advantageously.

Eleventh, various drum motions are performed alternatively and overheat generation may be suppressed advantageously.

Twelfth, the overheat generation may be suppressed and the washing ability may be improved advantageously.

Advantageous effects of the present invention may not be limited by the effects mentioned above and other effects not mentioned above may be obviously understood from the scope of claims by those skilled in the art.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

Reference will now be made in detail to the specific embodiments of the present invention, examples of which are illustrated in the accompanying drawings. Wherever possible, the same reference numbers will be used throughout the drawings to refer to the same or like parts.

As follows, a washing method and a washing machine according to embodiments of the present invention will be described in reference to the accompanying drawings.

Figure 1:
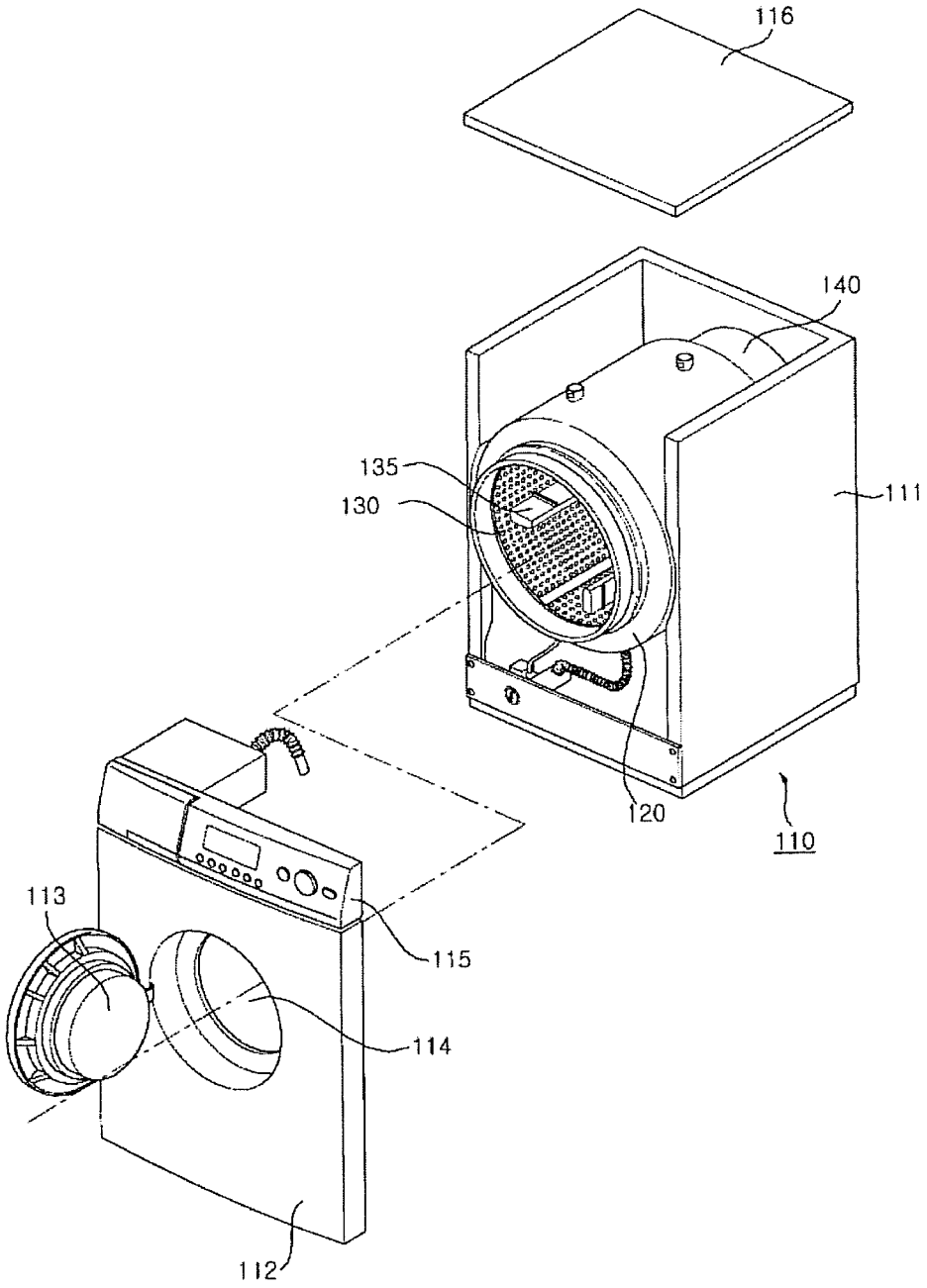
FIG. 1 is a perspective view illustrating a washing machine according to an embodiment of the present invention.

FIG. 1 is a perspective view illustrating a washing machine according to an embodiment of the present invention.

The washing machine according to the embodiment of the present invention includes a cabinet 110 configured to defines a profile of the washing machine, a tub 120 arranged in the cabinet 110 with being supported by the cabinet 110, a drum 130 arranged in the tub to rotate after receiving laundry therein, a driving part 140 configured to apply a torque to the drum 130 to rotate the drum 130, and a control panel 115 configured to receive a user's input to control an overall operation of the washing machine.

The cabinet 110 includes a cabinet body 111, a cabinet cover 112 arranged and coupled to a front of the cabinet body 111 and a top plate 116 coupled to the cabinet body. The cabinet cover 112 includes a laundry introduction opening 114 formed to allow laundry introduced therein and a door 113 rotatable in a right and left direction to open and close the laundry introduction opening.

The tub 120 is suspendedly mounted in the cabinet 110 by a spring (not shown) and a damper (not shown). The tub 120 holds wash water during the washing and the drum 130 is mounted in the tub 120.

The laundry is loaded into the drum 130 and the drum 130 is rotated with the laundry. A plurality of holes may be formed in the drum 130 to pass wash water there through and a lifter 125 may be mounted in the drum 130 to lift the laundry a predetermined height. The drum 130 is rotated by the driving part 140.

The driving part 140 applies a torque or a braking power to the drum 130. The driving part 140 is configured of a motor and a switching device for controlling the motor, and it is controlled by a control part 115 to realize various motions.

The control panel 115 receives the user's input. The control panel 115 controls an overall operation of the washing machine and it displays a current operational state. Here, the control panel 115 may be provided on an upper area of the cabinet cover 112. Here, in the control panel 115 may be an operation button to receive the user's input and a display device including a microcomputer and a display to control the operation of the washing machine.

Figure 2:
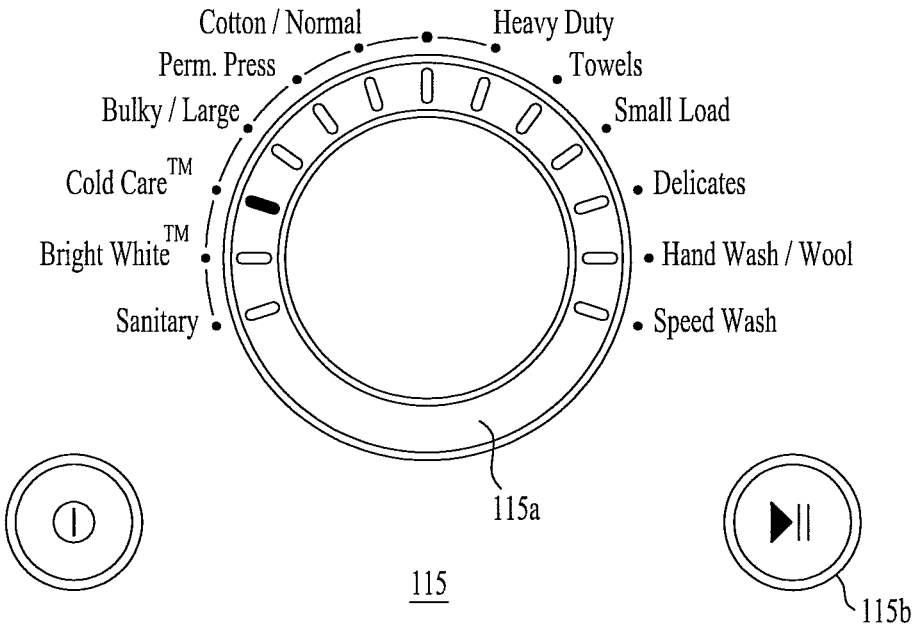
FIG. 2 is a partially enlarged view illustrating a control panel of the washing machine shown in FIG. 1.

FIG. 2 is a partially enlarged view illustrating the control panel of the washing machine shown in FIG. 1.

The control panel 115 provided in the washing machine according to the embodiment of the present invention includes a course selection dial 115*a* and a start button 115*b*.

The course selection dial 115*a* is a dial used by the user to select a washing course. The user rotates the dial to select a washing course. The course selection dial 115*a* includes various courses classified based on a laundry type, a contamination degree, a washing method and a washing time. According to this embodiment, a cold care course configured to perform washing by using cold water.

The start button 115*b* is a button used to start washing. When the user selects the course by using the dial course 115*a* and pushes the start button 115*b*, washing may start according to the selected course. A pausing function used to stop the washing temporarily may be added to the start button 115*b*.

When the user rotates the course selection dial 115*a* to select the cold care course for washing laundry by using cold water and he or she pushes the start button 115*b*, it is input to the microcomputer of the control panel 115 that the cold care course is selected. The microcomputer of the control panel 115 implements a washing method set for the cold care course.

Figure 3:
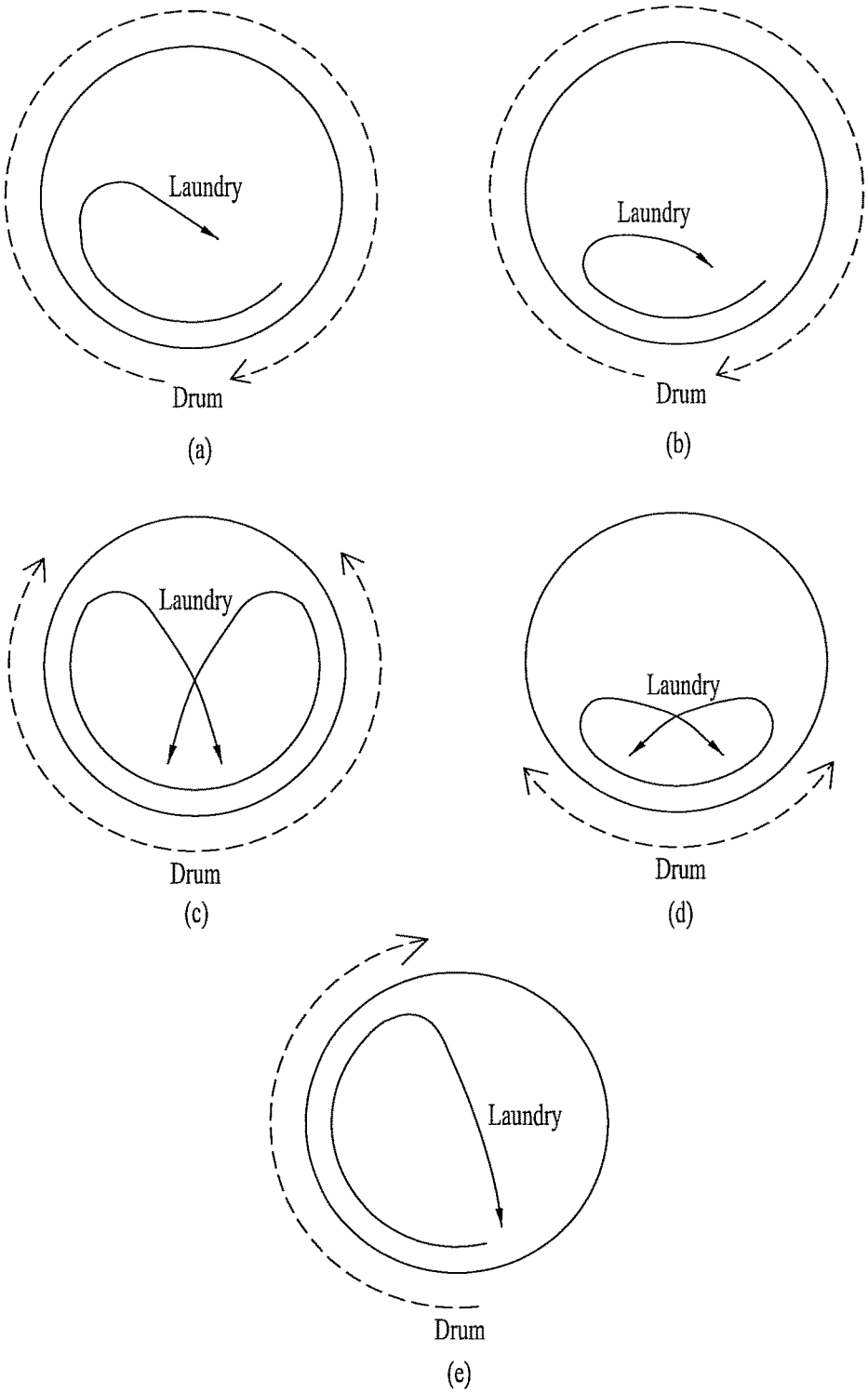
FIG. 3 is a diagram illustrating various drum motions of the washing machine according to the embodiment of the present invention.

FIG. 3 is a diagram illustrating various drum motions of the washing machine according to the present invention.

FIG. 3(*a*) illustrates a drum motion in which the laundry is lifted from the lowest point of the drum 130 once the driving part 140 rotates the drum 130 along a predetermined direction, to be dropped at approximately a half of the drum height (hereinafter, referenced to as "tumbling motion"). In the tumbling motion, the drum 130 is rotated at approximately 45 rpm constantly and the laundry loaded in the drum 130 is washed by a shock and a frictional force.

FIG. 3(*b*) illustrates a drum motion in which the laundry is lifted from the lowest point of the drum 130 once the driving part 140 rotates the drum 130 along a predetermined direction, to be dropped at a predetermined height not less than the half of the drum height (hereinafter, referenced to as "rolling motion"). In a rolling motion, the drum 130 constantly is rotated at approximately 40 rpm or less and the laundry is rolling dropped to be washed by extension/contraction and a frictional force.

FIG. 3(*c*) illustrates a drum motion in which the laundry is lifted from the lowest point of the drum 130 once the driving part 140 rotates the drum 130 in opposite directions, to be dropped at a predetermined height higher than the half of the drum height (hereinafter, referenced to as "scrub motion"). After the laundry is dropped, the drum 130 is rotated in the opposite direction and the laundry is then lifted over the half of the drum height. After that, the driving part 140 applies a brake to the drum 130 and the laundry is dropped. The laundry loaded in the drum 130 is washed by a shock generated from high-head and friction. The scrub motion repeats rapid acceleration and rapid braking, and much load is applied to the driving part 140. The scrub motion will be described in detail in reference to FIG. 5 later.

FIG. 3(*d*) illustrates a drum motion in which the laundry is lifted from the lowest point of the drum 130 once the driving part 140 rotates the drum 130 along opposite directions, to be dropped at near the half of the drum height (hereinafter, referenced to as "swing motion"). In a swing motion, the drum 130 is rotated at approximately 40 rpm or less along opposite directions and the laundry inside the drum 130 is rolling dropped, to be washed by extension/contraction and a frictional force.

FIG. 3(*e*) illustrates a drum motion in which the laundry is lifted from the lowest point of the drum 130 once the driving part 140 rotates the drum 130 along a predetermined direction, to be dropped at the peak of the drum 130 (hereinafter, referenced to as "step motion"). In a step motion, the drum 130 is rotated at approximately 60 rpm or more and the laundry is then lifted. After the laundry is lifted over the half of the drum height, the driving part 140 applies a braking to the drum 130 and the laundry is dropped at near the peak of the drum 130. After the laundry is dropped, the drum 130 is rotated along the same direction and the laundry is then lifted. Here, the laundry is washed by a strong shock generated from the high head. The step motion repeats rapid acceleration and rapid braking, and much load is applied to the driving part 140. The step motion will be described in detail in reference to FIG. 4 later.

Figure 4:
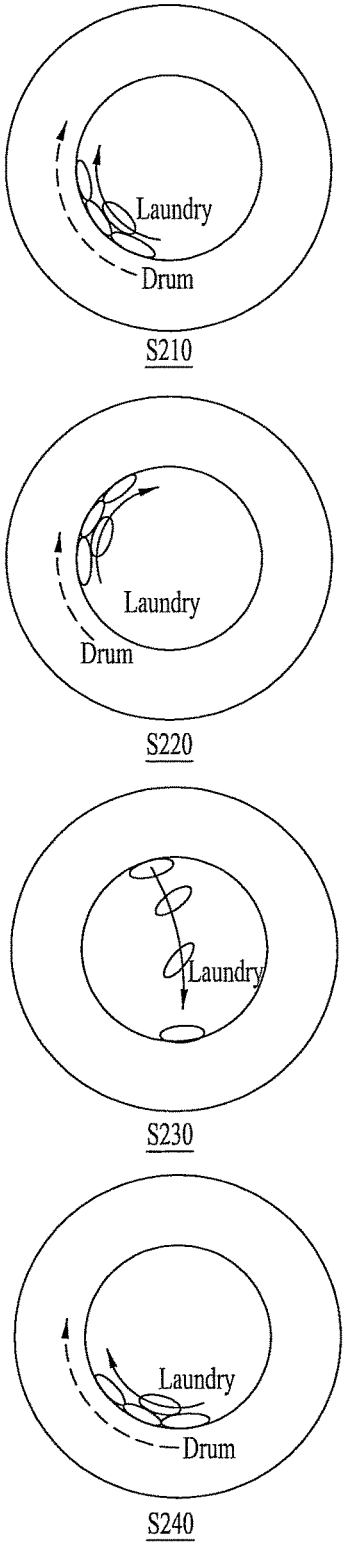
FIG. 4 is a diagram illustrating a step motion provided in a washing method according to an embodiment of the present invention.

FIG. 4 is a diagram illustrating the step motion of the washing method according to the embodiment of the present invention.

Once the driving part 140 applies a torque to the drum 130 along a predetermined direction, the drum 130 is rotated along the predetermined direction to rotate the laundry and the laundry is then lifted (S210). The driving part 140 applies a torque to the drum 130 along a predetermined direction when the laundry is located at the lowest point of the drum 130. Then, the drum 130 is rotated along the predetermined direction. When the drum 130 is rotated along the predetermined direction, the laundry is lifted by the lifter 135 and it is rotated along the predetermined direction. At this time, the drum 130 may be rotated at approximately 60 rpm or more to rotate the laundry in a state of contacting with the drum 130 closely.

When the height of the lifted laundry is over the half of the drum height, the driving part 140 applies a braking to the drum 130, to lower the velocity of the drum 130 (S220). When the position of the laundry is over approximately 165 degrees by the rotation of the drum 130 along the predetermined direction, the driving part 140 applies a braking to the drum 130. The driving part 140 may apply plugging braking and/or dynamic braking to the drum 130. It is preferable that the driving part 140 applies the plugging braking to the drum 130.

The driving part 140 brakes the drum 130 and the velocity of the drum 130 is lowered, to drop the laundry (S230). The laundry is dropped at the peak of the drum 130, near 180 degrees, which the highest head, to make the shock the strongest. While the laundry is falling, the velocity of the drum 130 may be getting lowered and it is preferable that a pausing state is maintained. At least predetermined amount of the laundry may be dropped when passing a central line of the drum 130.

After the laundry is dropped, the driving part 140 applies a torque to the drum 130 along a predetermined direction. Then, the drum 130 is rotated to rotate the dropped laundry and the laundry is re-lifted (S240). When the laundry is dropped after that, the driving part 140 re-applies a predetermined direction torque to the drum 130. When the drum 130 is rotated along the predetermined direction, the laundry is lifted by the lifter 135 and it is rotated along the predetermined direction. At this time, the drum 130 may be rotated at approximately 60 rpm or more to make the laundry be rotated in a state of contacting with the drum 130 closely.

The steps of S210 through S240 mentioned above are performed while the drum 130 is making a first rotation along the predetermined direction. This embodiment represents that the drum 130 is rotated along a clockwise direction. Alternatively, the drum 130 may be rotated along a counter-clockwise direction to implement the step motion.

Each of the steps is performed for a predetermined time period. However, each of the steps mentioned above generates much load applied to the driving part 140. Because of that, it is preferable that the steps are performed at a low net acting ratio. Here, the net acting ratio may be approximately 70%. In other words, the driving part 140 may be operating for approximately 10 seconds to perform the steps repeatedly and it may brake the drum 130 for approximately 4 seconds.

Figure 5:
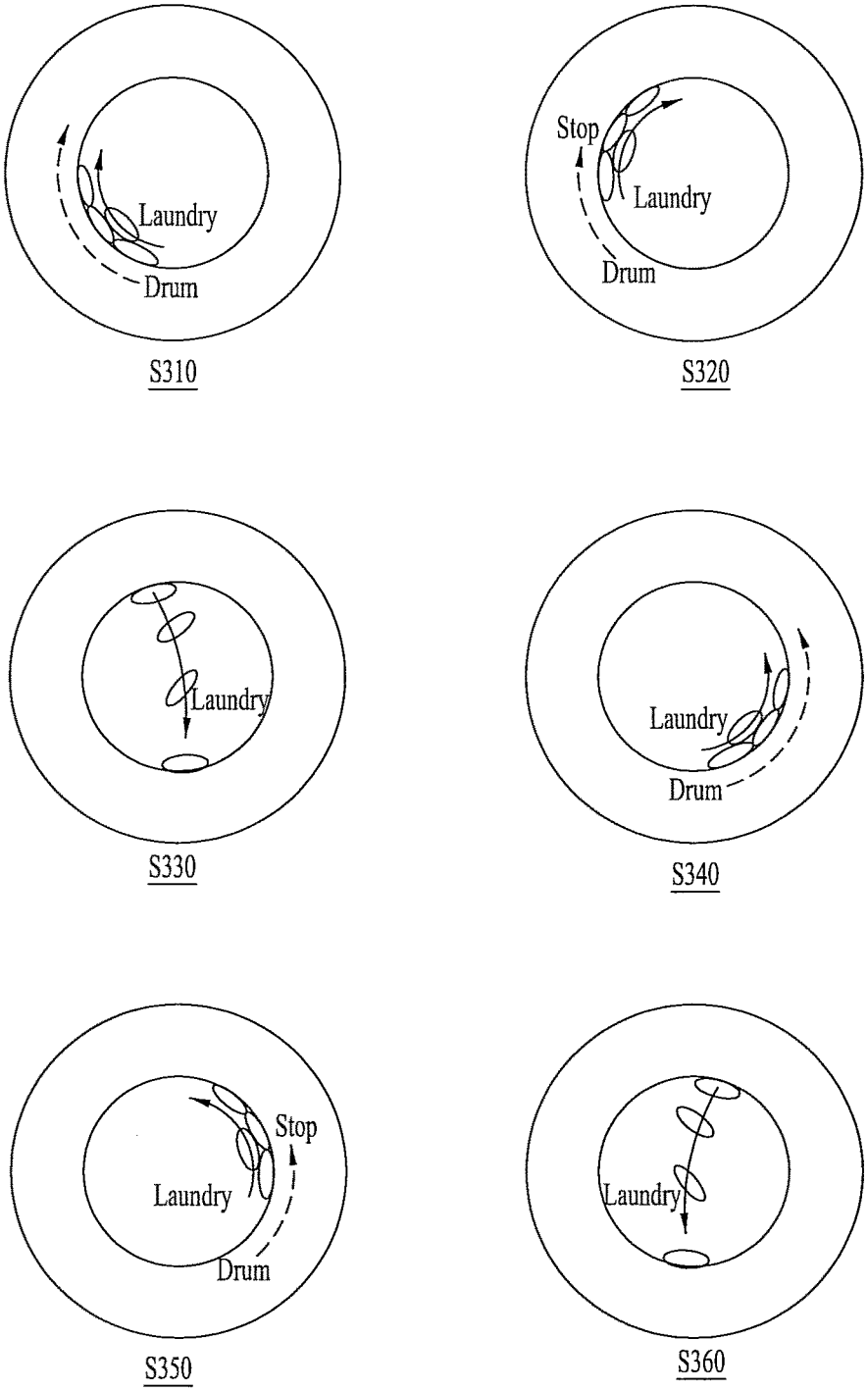
FIG. 5 is a diagram illustrating a scrub motion of the washing method according to the present invention.

FIG. 5 is a diagram illustrating the scrub motion of the washing method according to the embodiment of the present invention.

The driving part 140 applies a predetermined direction torque to the drum 130 and the drum 130 is rotated along the predetermined direction, to rotate the laundry inside the drum 130 along the predetermined direction (S310). When the driving part 140 applies to the predetermined direction torque to the drum 130, with the laundry located at the lowest point of the drum 130, the drum 130 is rotated along the predetermined direction. After that, the drum 130 is rotated along the predetermined direction and the laundry is lifted by the lifter 135 to be rotated along the predetermined direction. At this time, it is preferable that the drum 130 is rotated at approximately 60 rpm or more, to rotate the drum 130 in close contact with the drum 130.

When the largest height of the lifted laundry is over the half of the drum height after the rotation along the predetermined direction, the driving part 140 applies a braking to the drum 130 and the velocity of the drum 130 is lowered (S320). When the laundry is located over approximately 165 degrees by the rotation of the drum 130 along the predetermined direction, the driving part 140 applies a braking to the drum 130. The driving part 140 may apply a plugging braking and/or a dynamic braking to the drum 130. The plugging braking is preferable.

While the driving part 140 is applying a braking to the drum 130, the laundry is dropped (S330). The rotation of the drum 130 may be temporarily stopped by the braking applied by driving part 140. At this time, the laundry may be dropped. It is preferable that the laundry is dropped at the highest head to make the shock the strongest. In addition, at least predetermined amount of the laundry may be dropped after passing a central line of the drum 130.

After the laundry is dropped, the driving part 140 applies an opposite direction torque to the drum 130, the drum 130 is rotated along the opposite direction. Then, the laundry is lifted by the lifter 135 and it is rotated along the opposite direction. At this time, the drum 130 may be rotated at approximately 60 rpm or more to allow the laundry rotated in close contact with the drum 130.

When the maximum height of the laundry is over the half of the drum height by the rotation along the opposite direction, the driving part 140 applies a braking to the drum 130 to lower the velocity of the drum rotation (S350). When the position of the laundry is approximately 165 degrees by the rotation of the drum 130 along the opposite direction, the driving part 140 applies a braking to the drum 130. The driving part 140 applies a plugging braking and/or dynamic braking to the drum 130. Here, the plugging braking is preferable.

While the driving part 140 is braking the drum 130, the laundry is dropped (S360). The rotation of the drum 130 may be temporarily stopped by the braking applied by the driving part 140. At this time, the laundry may be dropped. The laundry is dropped at a position having the highest head and the shock may be the strongest. In addition, at least predetermined amount of the laundry may be dropped after passing the central line of the drum 130.

Each of the steps is performed for a predetermined time period repeatedly. However, each of them generates much load applied to the driving part 140 and the steps may be performed with a lowered net acting ratio. It is preferable that the net acting ratio is approximately 70%. In other words, the driving part 140 is driving for approximately 10 seconds to allow each of the steps performed repeatedly and the driving of the driving part 140 may be stopped for approximately 4 seconds.

Figure 6:
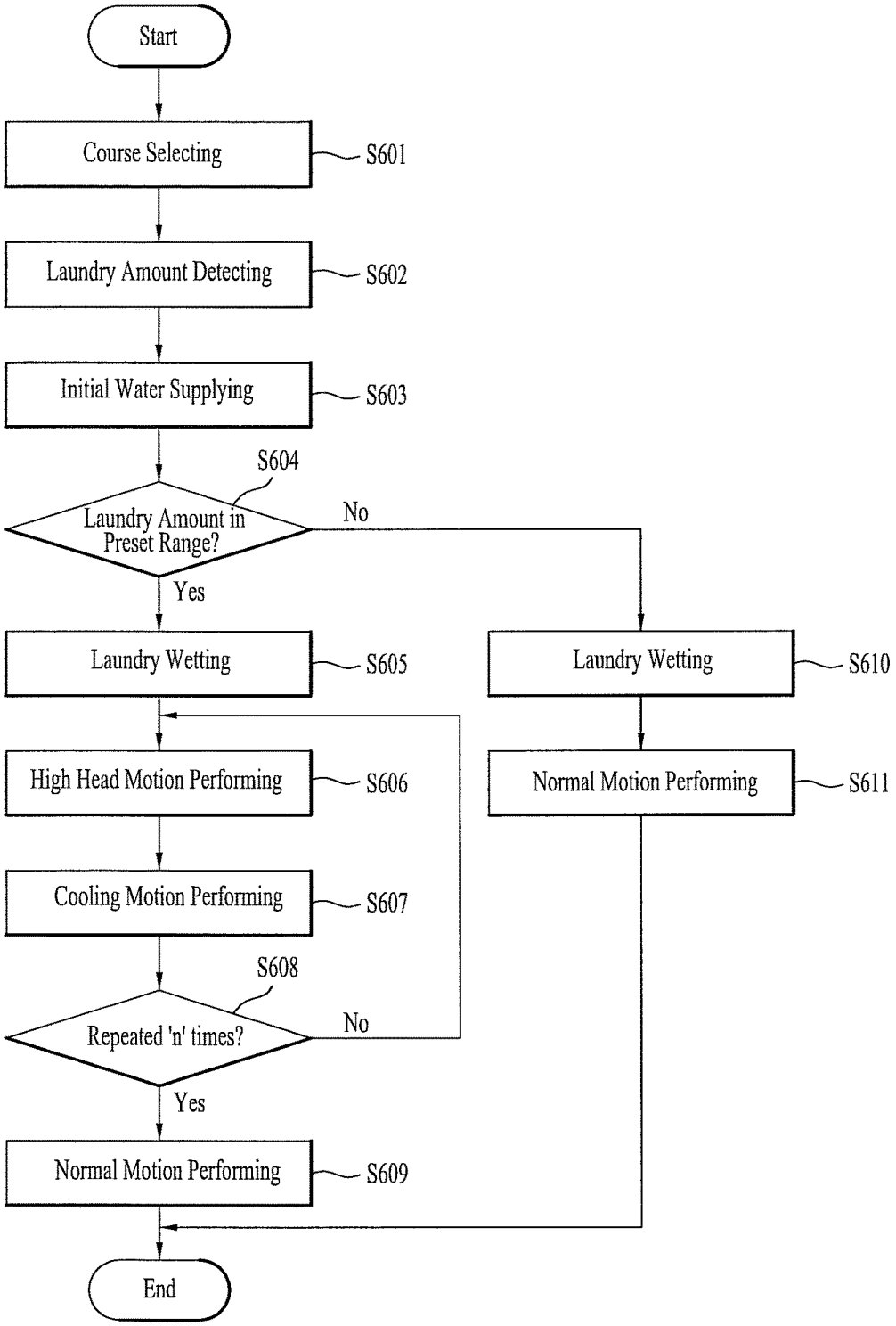
FIG. 6 is a flow chart illustrating the washing method according to an embodiment of the present invention.
Figure 7:
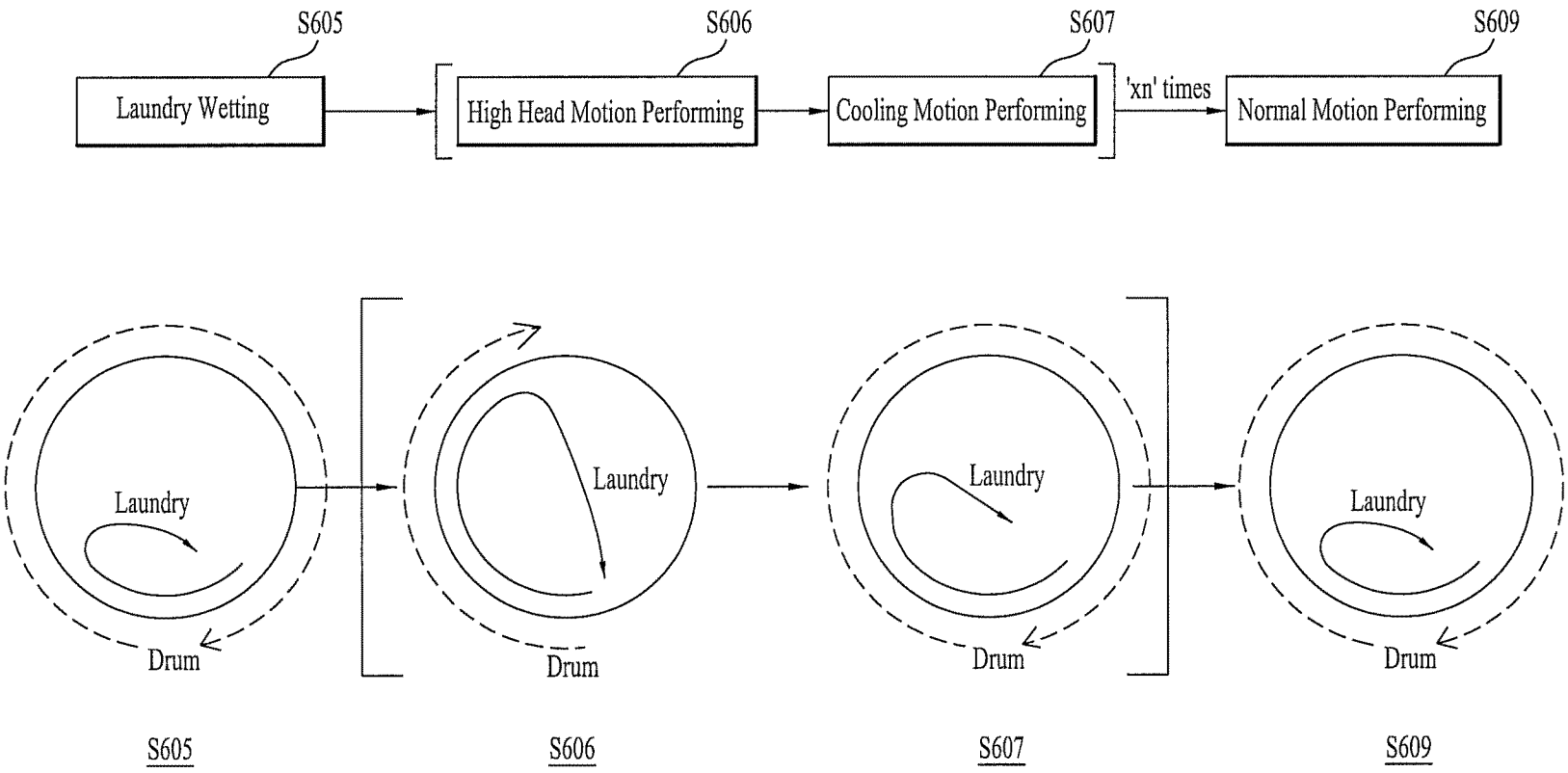
FIG. 7 is a diagram illustrating a drum motion corresponding to some of steps shown in the flow chart of FIG. 6.

FIG. 6 is a flow chart illustrating a washing method according to an embodiment of the present invention and FIG. 7 is a diagram illustrating a drum motion corresponding to some of steps shown in the flow chart of FIG. 6.

A course is selected and washing starts (S601). The user selects the course by using the operational button of the control panel 115 and he/she inputs a start button. The microcomputer of the control panel 115 implements a command of starting washing corresponding to the course. At this time, the selected course may be a course requiring high washing ability such as a course for heavy dirt or a washing course using cold water (in other words, cold care course).

According to this embodiment, the cold care course washing course is selected. The user rotates the course selection dial 115*a* to select a cold care course for using cold water to perform washing and he/she pushes the start button 115*b*. After that, it is inputted to the microcomputer of the control panel 115 that the cold care course is selected.

The amount of the laundry loaded into the drum 130 is detected (S602). The laundry amount detecting may be realized by a variety of methods or devices. According to this embodiment of the present invention, the time required to lower the velocity of the drum 130 after the driving part 140 rotates the drum 130 at a predetermined velocity for a predetermined time period may be measured, to detect the amount of the laundry. As the time taken to lower the velocity of the drum 130 is getting longer, a level of the laundry amount is getting higher. The laundry amount is calculated by the microcomputer of the control panel 115.

Hence, an initial water supply is performed (S603). External wash water is supplied to the washing machine and the tub 120 receives the wash water. When the cold care course is selected, external cold water is supplied to the tub 120. During the initial water supply, the cold water is mixed with detergent may be supplied to the tub 120.

It is determined whether the laundry amount is within a preset range (S604). It is determined whether the detected amount of the laundry is a preset level or less. The microcomputer of the control panel 115 determines whether the laundry amount is large or small, to determine a corresponding drum motion.

In case the laundry amount is within the preset range, laundry wetting is performed (S605). The laundry wetting is a process of moving the laundry to wet it with the wash water supplied to the tub 120. In case the laundry amount is within the preset range, it is preferable that the laundry wetting is performed according to the rolling motion as shown in FIG. 6. In other words, the driving part 140 rotates the drum 130 at a relatively low velocity along a predetermined direction to rolling drop the laundry, such that the laundry may be wet.

Once the laundry wetting is performed, a high head motion is performed (S606). In the high head motion, the laundry is lifted over the half of the drum height and the drum 130 is braked by the driving part 140 after that, to drop the laundry. The high head motion refers to the step motion or the scrub motion. The drum 130 is braked after rotated at approximately 60 rpm or more to rotate the laundry in close contact there with, such that the laundry is washed by a shock generated by the high head. It is preferable that the step motion is performed as shown in FIG. 7.

The high head motion generates much load applied to the driving part 140 and the high head motion is performed at a low net acting ratio. It is preferable that the net acting motion of the high head motion is approximately 70%. In other words, the driving part 140 is driving for approximately 10 seconds to perform the high head motion repeatedly and the driving of the driving part 140 is stopped for approximately 4 seconds.

After the high head motion is performed, a cooling motion is performed (S607). The high head motion repeats rapid acceleration and rapid braking. Because of that, much load is applied to the driving part 140 and a cooling motion is required. The cooling motion may be realized by various methods, for example, lowering the load applied to the driving part 140. The embodiment of the present invention represents that the tumbling motion having a low net acting ratio is performed as shown in FIG. 6 as cooling motion.

It is preferable that the net acting ratio is approximately 50% in the cooling motion. The driving part 140 is driving for approximately 8 seconds to rotate the drum 130 according to the tumbling motion. After that, the driving of the driving part 140 is stopped for approximately 8 seconds and the load applied to the driving part 140 is reduced.

The cooling motion has an effect of loosening the laundry entangled by the high head motion as well as the effect of reducing the load applied to the driving part 140.

According to other embodiments, the cooling motion may be replaced with various cooling methods performed to cool the driving part 140 by operating a fan provided in the washing machine or by using the wash water.

It is determined whether the high head motion and the cooling motion are performed 'n' times (S608). The high head motion generates much load on the driving part 140 and it is preferable that the high head motion and the cooling motion are performed mixedly and repeatedly. After the high head motion is performed for not more than 1 minute, the cooling motion is repeated 'n' times. The repeated frequency 'n' is differentiated by the selected course and the laundry amount.

In case the cooling motion is repeated with the frequency of 'n', a normal motion is performed (S609). The normal motion is the tumbling motion, the rolling motion or the swing motion. Typically, washing is performed according to the tumbling motion. In case the laundry amount is within the preset range, washing may be performed according to the rolling motion as shown in FIG. 6.

After the normal motion is performed, a rinsing cycle and a spinning cycle may be performed continuously.

When the amount of the laundry is out of the preset range, the laundry wetting (S610) and the normal motion may be performed (S611). When the laundry amount is out of the preset range, the laundry wetting may be performed according to the tumbling motion not to generate overload applied to the driving part 140. In addition, the normal motion may be performed according to the tumbling motion.

After the normal motion is performed, the rinsing cycle and the spinning cycle may be performed continuously.

Experimental values of a washing ability and energy consumption with respect to the cold care washing and hot water washing will be as follows:

TABLE 1

| Course | | Cold Care | Normal Course (Warm) |
|---|---|---|---|
| Washing Ability (Reflectivity Total) | | 208.2 | 206.9 |
| Energy Consumption | Warm Water (L) | 0 | 3.59 |
| | Cold Water (L) | 47.31 | 46.52 |
| | Conversion (wh) | 0 | 170.5 |
| | Electricity (wh) | 139.1 | 121.6 |
| | Total (wh) | 139.1 | 292.2 |

In Table 1, experimental values are calculated in the cold care washing when the laundry is washed according to the step motion corresponding to the high head motion. According to Table 1, the washing ability is improved and the energy consumption is reduced when the cold care washing is performed according to the washing method of the embodiment.

Figure 8:
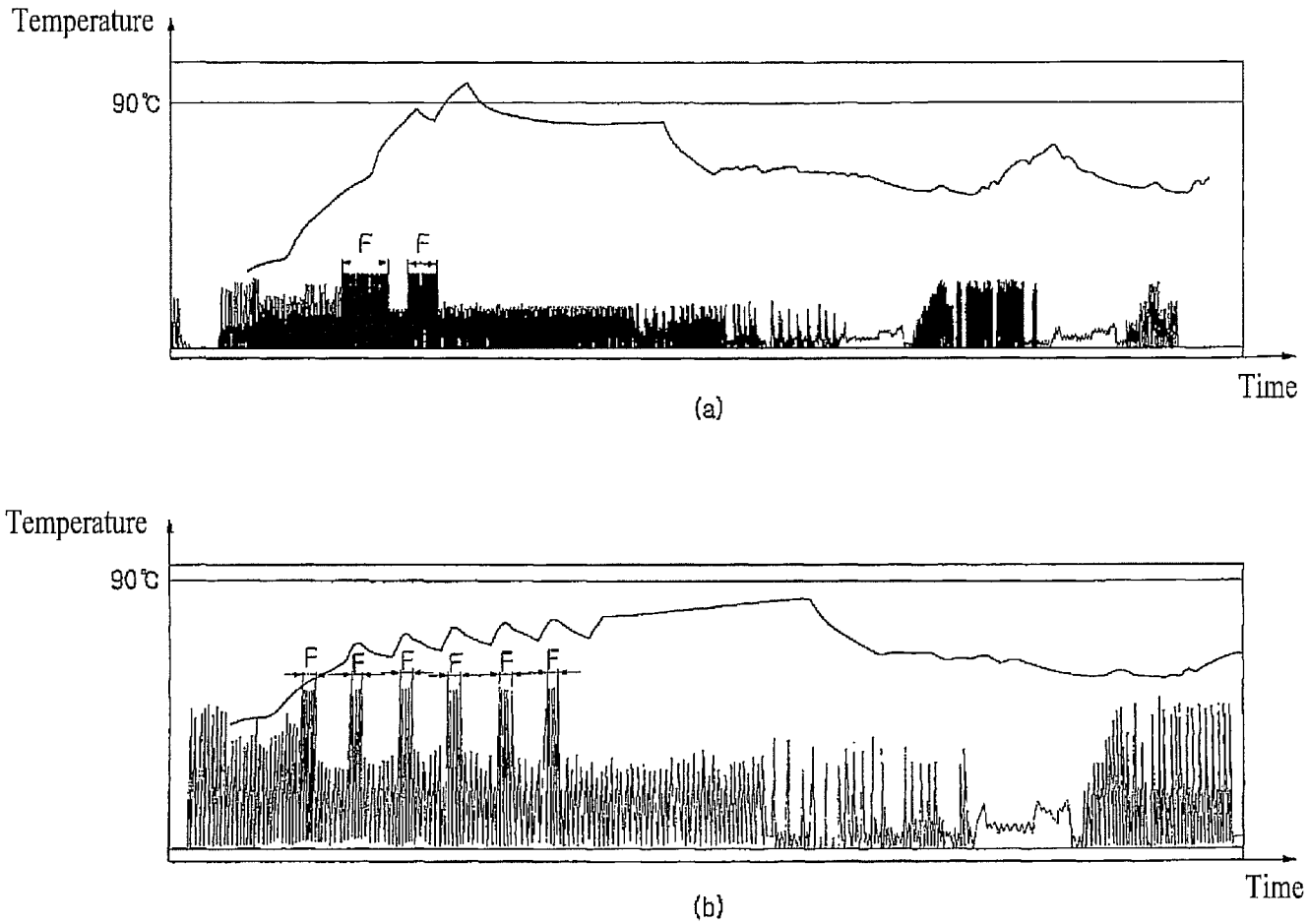
FIG. 8 is a diagram illustrating temperature change for the washing method according to the embodiment of the present invention.

FIG. 8 is a diagram illustrating temperature change in the washing method according to the embodiment of the present invention.

'F' period of FIG. 8 refers to a period in which the high head motion is performed. FIG. 8(*a*) refers to temperature change when the normal motion is performed after the high head motion is performed for 3 minutes and the normal motion is performed after the high head is re-performed for 2 minutes. At this time, the temperature of the driving part 140 is increased to 90°C or more to generate over-heat.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A washing method, comprising:

rotating a drum along a predetermined direction to lift laundry;

detecting an amount of laundry loaded in the drum having a horizontal rotational axis, while the drum is rotating;

performing a high head motion of dropping the laundry by braking the drum after the laundry is lifted over a half of the drum height by rotation of the drum about a horizontal axis, wherein the high head motion includes:

braking the drum when a height of the lifted laundry is over the half of the drum height; and repeating the rotating and the braking of the drum, wherein the drum rotates in only one of clockwise or counterclockwise during the high head motion, and wherein the high head motion is performed when the amount of the laundry detected is below a predetermined amount, and performing a normal motion of rotating the drum in a predetermined direction and at a predetermined RPM to drop the laundry from a height of not more than half of the drum height, wherein the normal motion is implemented when the amount of the laundry is above the predetermined amount.

2. The washing method as claimed in claim 1, wherein the braking of the drum brakes the drum so that the laundry lifted from a lowest point of the drum is dropped near a peak of the drum.

3. The washing method as claimed in claim 1, wherein the high head motion stops driving of a drive for a predetermined time period after allowing the drive rotating the drum to rotate and brake the drum repeatedly.

4. The washing method as claimed in claim 3, wherein a time of the high head motion taken for the drive to rotate and brake the drum is 70% of an entire time of the high head motion.

5. The washing method as claimed in claim 1, further comprising:

performing a cooling motion of dropping the laundry near a half of the drum height by rotating the drum constantly, after the high head motion.

6. The washing method as claimed in claim 5, wherein the cooling motion stops the driving of the drive for a predetermined time period after it allows the drive to rotate the drum.

7. The washing method as claimed in claim 6, wherein a time of the cooling motion taken for the drive to rotate the drum is 50% of an entire time of the cooling motion.

8. The washing method as claimed in claim 5, further comprising:

performing a normal motion of rolling-dropping the laundry lifted from a lowest point of the drum by rotating the drum along a predetermined direction from a height not more than half of the drum height, after repeating the high head motion and the cooling motion.

9. The washing method as claimed in claim 1, further comprising:

performing a cooling operation of cooling a drive that rotates the drum by operating a fan, after the high head motion.

10. The washing method as claimed in claim 1, further comprising:

performing a cooling operation of cooling a drive that rotates the drum by using wash water, after the high head motion.

11. The washing method as claimed in claim 1, further comprising:

inputting a course washing the laundry using cold water; and supplying cold water to a tub for surrounding the drum.

12. The washing method as claimed in claim 1, wherein the amount of laundry detected is based on a measured time that is required to stop the rotation of the drum rotating at a predetermined velocity.

* * * * *